US011370625B2

(12) United States Patent
Okada et al.

(10) Patent No.: US 11,370,625 B2
(45) Date of Patent: Jun. 28, 2022

(54) SHEET CONVEYING DEVICE, RELAY CONVEYANCE DEVICE AND IMAGE FORMING SYSTEM

(71) Applicant: KYOCERA Document Solutions Inc., Osaka (JP)

(72) Inventors: Seiji Okada, Osaka (JP); Masami Fuchi, Osaka (JP); Sachio Izumichi, Osaka (JP); Masayuki Kakuta, Osaka (JP); Risa Hibino, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 416 days.

(21) Appl. No.: 16/559,437

(22) Filed: Sep. 3, 2019

(65) Prior Publication Data

US 2020/0071105 A1 Mar. 5, 2020

(30) Foreign Application Priority Data

Sep. 3, 2018 (JP) ..... JP2018-164888

(51) Int. Cl.
*B65H 9/10* (2006.01)
*B65H 5/06* (2006.01)
(Continued)

(52) U.S. Cl.
CPC ..... *B65H 9/103* (2013.01); *B65H 5/062* (2013.01); *B65H 9/002* (2013.01); *B65H 9/20* (2013.01); *B65H 15/004* (2020.08)

(58) Field of Classification Search
CPC ..... B65H 9/103; B65H 9/20; B65H 9/002; B65H 5/062; B65H 7/10; B65H 2404/1441
See application file for complete search history.

(56) References Cited

U.S. PATENT DOCUMENTS 8,764,008 B2 * 7/2014 Otsuki ..... B65H 9/06 271/251
2013/0049287 A1 * 2/2013 Ueda ..... B65H 9/002 271/110

(Continued)

FOREIGN PATENT DOCUMENTS

JP 2004018194 A * 1/2004
JP 2005-156578 A 6/2005

(Continued)

*Primary Examiner* — Luis A Gonzalez
(74) *Attorney, Agent, or Firm* — Studebaker & Brackett PC

(57) ABSTRACT

A sheet conveying device includes a correcting unit. The correcting unit corrects displacement of a sheet conveyed from an upstream side conveying path, and conveys the sheet to a downstream side conveying path. The correcting unit includes a first conveying part conveying the sheet, a first moving part moving a first frame supporting the first conveying part and a detecting part detecting a side end edge of the sheet at a reference position without displacement. The first conveying part stops conveyance of the sheet when a leading end of the sheet reaches the detecting part. While the driving of the first conveying part is stopped, the first moving part moves the first frame to move the sheet, and stops movement of the first frame, when detection result of the detecting part is changed, to position the side end edge to the reference position to correct displacement of the sheet.

16 Claims, 5 Drawing Sheets

(51) Int. Cl.

| | |
|---|---|
| ***B65H 9/20*** | (2006.01) |
| ***B65H 9/00*** | (2006.01) |
| ***B65H 15/00*** | (2006.01) |

(56) References Cited

U.S. PATENT DOCUMENTS

| | | | | |
|---|---|---|---|---|
| 2013/0134662 | A1* | 5/2013 | Moriya | B65H 9/002 271/227 |
| 2015/0097333 | A1* | 4/2015 | Kimura | B65H 7/02 271/227 |

FOREIGN PATENT DOCUMENTS

| | | | |
|---|---|---|---|
| JP | 2007-145603 | A | 6/2007 |
| JP | 2008-189395 | A | 8/2008 |

* cited by examiner

SHEET CONVEYING DEVICE, RELAY CONVEYANCE DEVICE AND IMAGE FORMING SYSTEM

INCORPORATION BY REFERENCE

This application is based on and claims the benefit of priority from Japanese Patent application No. 2018-164888 filed on Sep. 3, 2018, the entire contents of which are incorporated herein by reference.

BACKGROUND

The present disclosure relates to a sheet conveying device, a relay conveyance device, and an image forming system including this relay conveyance device.

An image forming system is known to include an image forming apparatus that is connected to a post-processing device having staple, punch, saddle stitch book binding and other functions or an option device, such as a large capacity stacker. Such an image forming system has a tendency to enlarge attachment difference in connection parts between devices or sheet displacement in an orthogonal direction to a conveying direction due to lengthening of a conveyance path in comparison with a signal image forming apparatus. This tendency strikingly occurs in the option device connected at a downstream side in a sheet conveying direction and causes degradation of position accuracy of post-process.

Thereupon, technology detecting and correcting sheet displacement is considered.

SUMMARY

In accordance with the present disclosure, a sheet conveying device includes a correcting unit and a controller. The correcting unit is arranged between an upstream side conveying path and a downstream side conveying path, corrects displacement of a sheet conveyed from the upstream side conveying path, and conveys the sheet to the downstream side conveying path. The controller controls the correcting unit. The correcting unit includes a first conveying part, a first frame, a first moving part a detecting part and a second frame. The first conveying part conveys the sheet. The first frame supports the first conveying part. The first moving part moves the first frame in a width direction orthogonal to a conveying direction. The detecting part is arranged at a downstream side from the first conveying part in the conveying direction, and detects a side end edge of the sheet in the width direction at a predetermined reference position. The second frame supports the detecting part. The reference position is a position through where the side end edge of the sheet passes without displacement in the width direction. The controller drives the first conveying part to convey the sheet and to stop conveyance of the sheet at timing when a leading end of the sheet reaches the detecting part. In a state that the driving of the first conveying part is stopped, the controller drives the first moving part to move the first frame in the width direction and thereby to move the sheet in the width direction, and to stop movement of the first frame at a position of the first frame when detection result of the detecting part is changed and thereby to position the side end edge of the sheet to the reference position to correct displacement of the sheet. The controller drives the first conveying part to convey the sheet to the downstream side conveying path.

The above and other objects, features, and advantages of the present disclosure will become more apparent from the following description when taken in conjunction with the accompanying drawings in which a preferred embodiment of the present disclosure is shown by way of illustrative example.

DETAILED DESCRIPTION

Hereinafter, with reference to the drawings, an image forming system 1 according to an embodiment of the present disclosure will be described. Arrows L, R, U, Lo, Fr and Rr in each of the drawings respectively indicate a left side, a right side, an upper side, a lower side, a front side and a rear side of the image forming system 1. An "upstream (side)" and a "downstream (side)" in below description indicate an "upstream (side)" and a "downstream (side)" in a conveying direction of a sheet in the image forming system 1.

Figure 1:
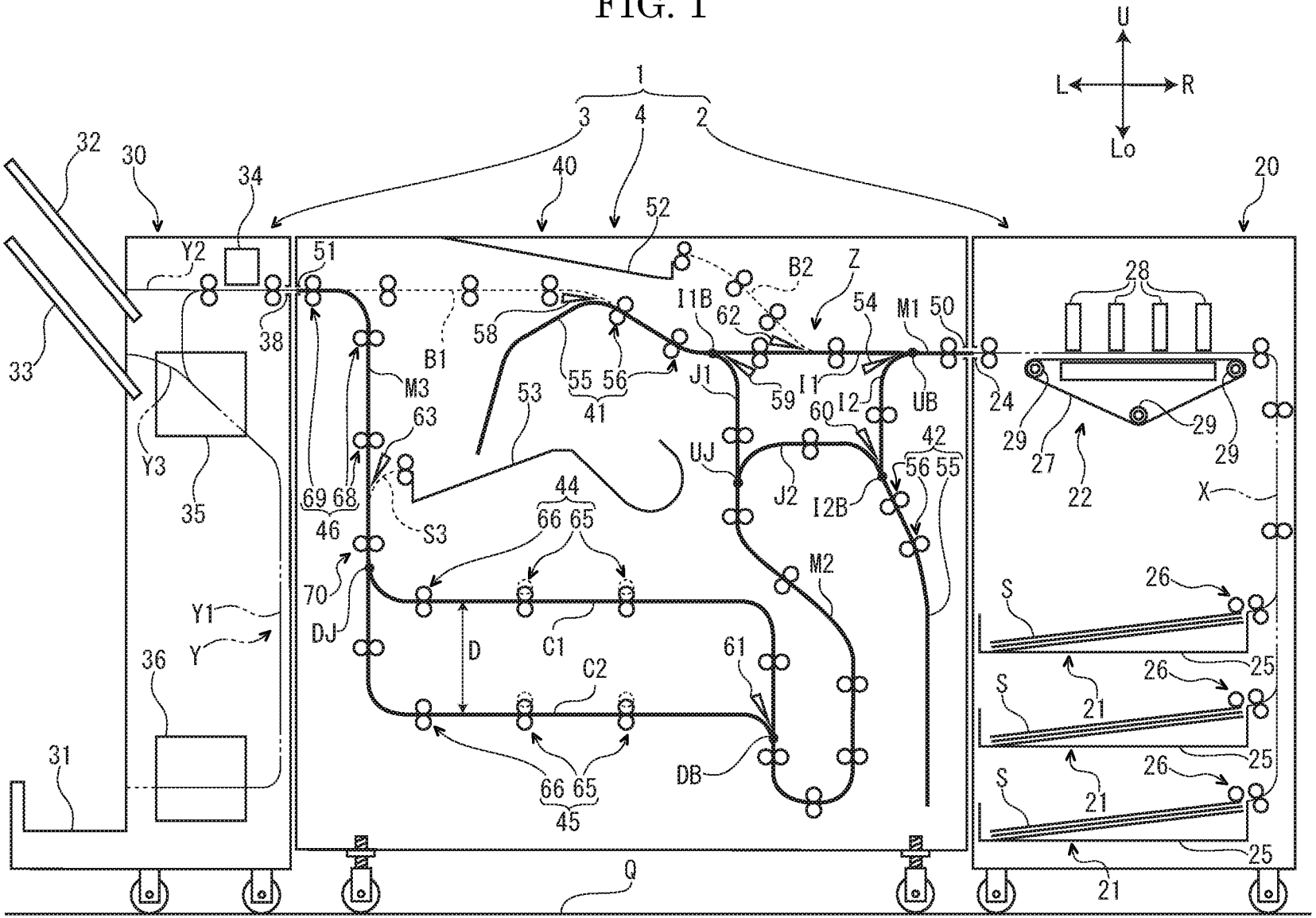
FIG. 1 is a sectional view schematically showing an image forming system according to an embodiment of the present disclosure.

First, with reference to FIG. 1, the image forming system 1 according to the embodiment will be described. FIG. 1 is a sectional view schematically showing the image forming system 1. Hereinafter, for convenience of description, it will be described so that the front side of the relay conveyance device 4 is positioned at a near side on a paper sheet of FIG. 1.

As shown in FIG. 1, the image forming system 1 includes an image forming apparatus 2 forming an image on a sheet S, a post-processing device 3 carrying out post-process of the sheet on which the image is formed by the image forming apparatus 2, and the relay conveyance device 4 relaying the sheet between the image forming apparatus 2 and the post-processing device 3.

First, structure of the image forming apparatus 2 will be described.

The image forming apparatus 2 includes a box-shaped apparatus body 20, a plurality of sheet feeding parts 21 housed in a lower part of the apparatus body 20, and an image forming part 22 housed in an upper part of the apparatus body 20.

Inside the apparatus body 20 of the image forming apparatus 2, a conveyance path X conveying the sheet is provided. At a downstream end of the conveyance path X, an ejecting port 24 is provided. The ejecting port 24 is opened in an upper part of a left face (a lateral face at a side of the relay conveyance device 4) of the apparatus body 20.

The plurality of sheet feeding parts 21 of the image forming apparatus 2 are located at an upstream end of the conveyance path X. The plurality of sheet feeding parts 21 are juxtaposed in upward and downward directions. Each sheet feeding part 21 includes a sheet feeding cartridge 25 storing the sheet S, and a sheet feeding mechanism 26 arranged at a right upper side of the sheet feeding cartridge 25. The sheet S is made of, for example, paper, synthetic resin or cloth.

The image forming part 22 of the image forming apparatus 2 is arranged at a downstream part of the conveyance path X. The image forming part 22 adopts an ink-jet manner. The image forming part 22 includes a conveyance belt 27, and four recording heads 28 arranged above the conveyance belt 27. The conveyance belt 27 is wound around a plurality of rollers 29 and rotatably supported by plurality of rollers 29. The recording heads 28 eject inks of respective different colors.

Next, operation of the image forming apparatus 2 will be described.

First, in each sheet feeding part 21, the sheet feeding mechanism 26 picks up the sheet S from the sheet feeding cartridge 25, and feeds out the sheet S to the conveyance path X. The sheet S fed out to the conveyance path X is conveyed to the downstream side on the conveyance path X to enter the image forming part 22. The sheet S entered the image forming part 22 is absorbed onto an upper face of the conveyance belt 27 and conveyed to the downstream side in accordance with rotation of the conveyance belt 27. Each recording head 28 ejects the ink from an upper side to the sheet S absorbed on the upper face of the conveyance belt 27. Thereby, the image is formed on the sheet S. The sheet S with the formed image is further conveyed to the downstream side on the conveyance path X and ejected from the conveyance path X via the ejecting port 24.

Next, structure of the post-processing device 3 will be described.

The post-processing device 3 includes a casing 30, a plurality of ejection trays 31-33 protruded from a left face of the casing 30, and a plurality of post-processing mechanisms 34-36 housed in the casing 30.

Inside the casing 30 of the post-processing device 3, a conveyance path Y conveying the sheet S is provided. The conveyance path Y includes a first path Y1, a second path Y2 branched off from an upstream part of the first path Y1, and a third path Y3 branched off from a middle-stream part of the first path Y1. At an upstream end of the first path Y1, an introducing port 38 is provided. The introducing port 38 is opened in an upper part of a right face (a lateral face at a side of the relay conveyance device 4) of the casing 30.

The plurality of ejection trays 31-33 of the post-processing device 3 includes a first ejection tray 31 arranged at a downstream end of the first path Y1, a second ejection tray 32 arranged at a downstream end of the second path Y2, and a third ejection tray 33 arranged at a downstream end of the third path Y3.

The plurality of post-processing mechanisms 34-36 of the post-processing device 3 includes a punching mechanism 34 arranged at an upstream part of the first path Y1, a staple mechanism 35 arranged at an upstream part of a branch part between the first path Y1 and the third path Y3, and a sheet folding mechanism 36 arranged at a downstream part of the first path Y1.

Next, operation of the post-processing device 3 will be described.

When the sheet S with the image formed by the image forming apparatus 2 is ejected from the relay conveyance device 4 (described later in detail) to the post-processing device 3, the sheet S is introduced to the first path Y1 via the introducing port 38. The sheet S introduced to the first path Y1 enters the punching mechanism 34. The punching mechanism 34 carries out punching process to the sheet S in accordance with inputted instruction. In one route, the sheet S passed through the punching mechanism 34 enters the second path Y2 and is ejected from the downstream end the second path Y2 to the second ejection tray 32. In the other route, the sheet S passed through the punching mechanism 34 is further conveyed to the downstream side on the first path Y1 and enters the staple mechanism 35. The staple mechanism 35 carries out staple process to the sheet S in accordance with inputted instruction. In one route, the sheet S passed through the staple mechanism 35 enters the third path Y3 and is ejected from the downstream end the third path Y3 to the third ejection tray 33. In the other route, the sheet S passed through the staple mechanism 35 is further conveyed to the downstream side on the first path Y1 and enters the sheet folding mechanism 36. The sheet folding mechanism 36 carries out sheet folding process to the sheet S in accordance with inputted instruction. In one route, the sheet S passed through the sheet folding mechanism 36 is ejected from the downstream end the first path Y1 to the first ejection tray 31.

Next, structure of the relay conveyance device 4 will be described.

The relay conveyance device 4 is configured as a separate device from the image forming apparatus 2 and the post-processing device 3. The relay conveyance device 4 is connected to the image forming apparatus 2 and the post-processing device 3 in a removable state.

Inside a housing 40 of the relay conveyance device 4, a relay conveyance path Z conveying sheet S is provided. Therefore, the relay conveyance device 4 may be called as a sheet conveying device. The relay conveyance path Z is arranged between the conveyance path X of the image forming apparatus 2 and the conveyance path Y of the post-processing device 3 to relay conveyance of the sheet S from the conveyance path X to the conveyance path Y. The relay conveyance path Z includes a first main path M1, a first inverting path I1, a second inverting path 12, a first joining path J1, a second joining path J2, a second main path M2 (an example of an upstream side conveying path), a first correcting path C1, a second correcting path C2 and a third main path M3 (an example of a downstream side conveying path).

The first main path M1 is a most upstream part of the relay conveyance path Z, and a relay introducing port 50 is arranged in an upstream end of the first main path M1. The relay introducing port 50 is opened in an upper part of a right face (a lateral face at a side of the image forming apparatus 2) of the housing 40, and faces to the ejecting port 24 of the image forming apparatus 2.

In a downstream end of the first main path M1, an upstream side branching point UB is provided, and the first main path M1 branches off at the upstream side branching point UB into the first joining path J1 and the second joining path J2. At the upstream side branching point UB, a first branching pawl 54 is provided. The first branching pawl 54 has a rotatable wedge-shaped pawl member, and a driving part (not shown), such as a motor, rotating the pawl member. The first joining path J1 is branched off at a first inverting path branching point I1B from the first inverting path I1. At the first inverting path branching point I1B, a third branching pawl 59 similar to the first branching pawl 54 is provided. The second joining path J2 is branched off at a second inverting path branching point I2B from the second inverting path 12. At the second inverting path branching point I2B, a seventh branching pawl 60 similar to the first branching pawl 54 is provided. The first joining path J1 and the second joining path J2 join at an upstream side joining point UJ.

To the upstream side joining point UJ, an upstream end of the second main path M2 (an example of an upstream side conveying path) is connected. In a downstream end of the second main path M2, a downstream side branching point DB is provided, and the second main path M2 branches off at the downstream side branching point DB into the first correcting path C1 and the second correcting path C2. The first correcting path C1 and the second correcting path C2 have equal conveyance distances. At the downstream side branching point DB, a fourth branching pawl 61 (an example of a guiding part) similar to the first branching pawl 54 is provided. The first correcting path C1 and the second correcting path C2 join at a downstream side joining point DJ.

The third main path M3 is a most downstream part of the relay conveyance path Z, and an upstream end of the third main path M3 is connected to the downstream side joining point DJ. In a downstream end of the third main path M3, a relay ejecting port 51 is arranged. The relay ejecting port 51 is opened in an upper part of a left face (a lateral face at a side of the post-processing device 3) of the housing 40, and faces to the introducing port 38 of the post-processing device 3.

The relay conveyance device 4 includes a first inverting unit 41 housed in an upper part of the housing 40, a second inverting unit 42 housed in a right part of the housing 40, a first correcting unit 44 and a second correcting unit 45 housed in a lower part of the housing 40, and an accelerating unit 46 housed in a left part of the housing 40.

The first inverting unit 41 is arranged on the first inverting path I1, and the second inverting unit 42 is arranged on the second inverting path 12. That is, the first inverting unit 41 and the second inverting unit 42 are arranged in parallel between the first main path M1 and the second main path M2.

Each of the inverting units 41 and 42 includes an inverting section 55, and two pairs of inverting rollers 56 arranged at an upstream part of the inverting section 55.

The first correcting unit 44 is arranged on the first correcting path C1, and the second correcting unit 45 is arranged on the second correcting path C2. That is, the first correcting unit 44 and the second correcting unit 45 are arranged in parallel between the second main path M2 and the third main path M3. The first correcting unit 44 and the second correcting unit 45 are juxtaposed in the upward and downward directions.

Figure 2A:
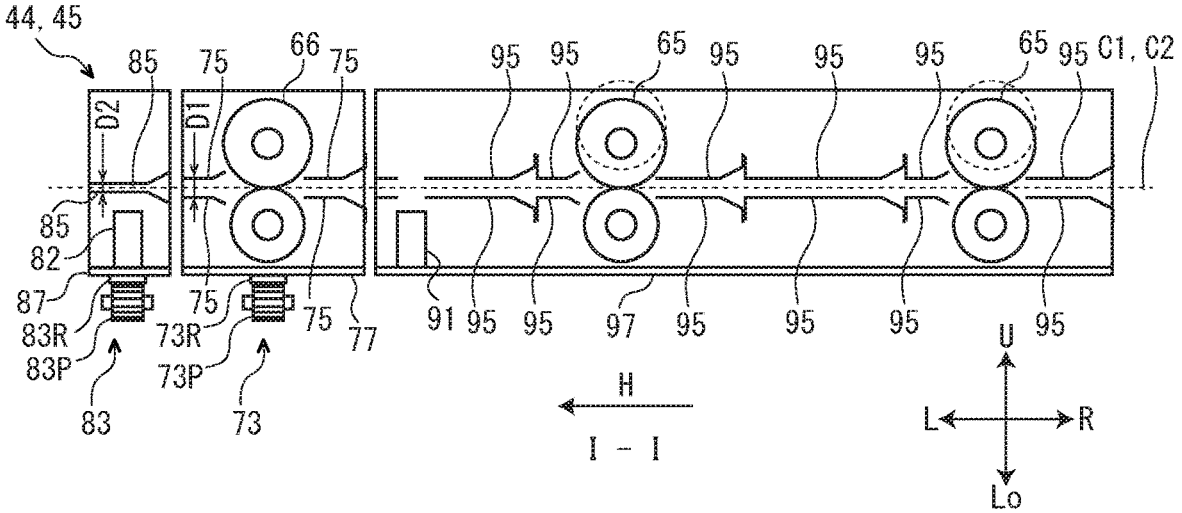
FIG. 2A is a sectional view showing a correcting unit according to the embodiment of the present disclosure.
Figure 2B:
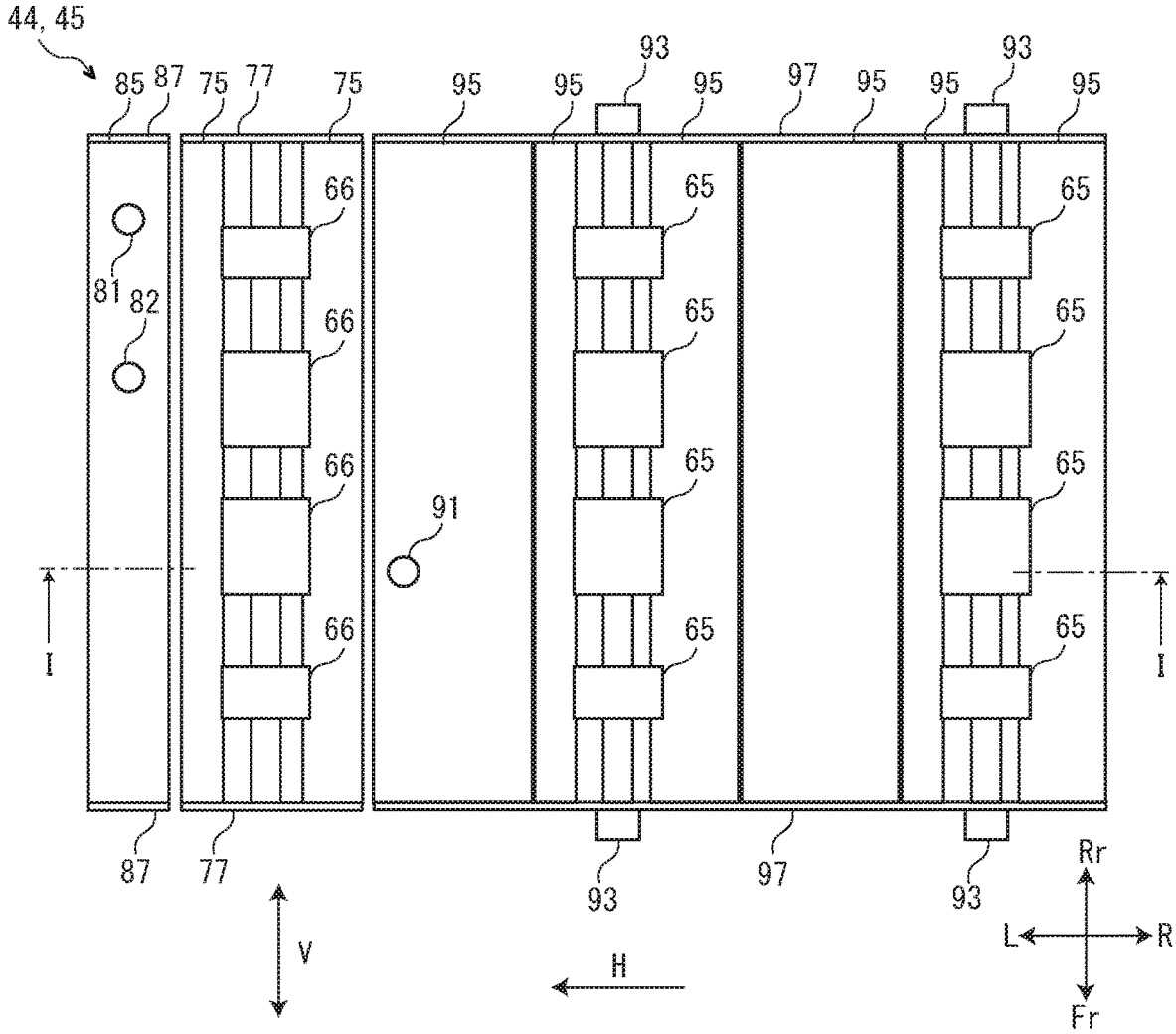
FIG. 2B is a plane view showing the correcting unit according to the embodiment of the present disclosure.

With reference to FIGS. 2A and 2B, structures of the correcting units 44 and 45 will be described. FIG. 2A is a sectional view of each of the correcting units 44 and 45. FIG. 2B is a plane view of each of the correcting units 44 and 45.

Each of the correcting units 44 and 45 includes a pair of correcting rollers 66 (an example of a first conveying part) conveying the sheet S along each of the correcting paths C1 and C2, a first moving part 73 moving the pair of correcting rollers 66 in an orthogonal direction (forward and backward directions or a width direction, hereinafter called as an orthogonal direction V) to a conveying direction H (a direction from right to left) of the sheet S, and first guiding members 75 (a pair of first guiding members) facing to both face of the sheet S and guiding conveyance of the sheet S of the pair of correcting rollers 66.

Moreover, each of the correcting units 44 and 45 includes a first reference sensor 81 (an example of a detecting part) and a second reference sensor 82 (an example of a detecting part) arranged at the downstream side from the pair of correcting rollers 66 in the conveying direction H to detect the sheet S at respective reference positions corresponding to ends of the different sheets S in the orthogonal direction V, a second moving part 83 moving the first reference sensor 81 and the second reference sensor 82 in the orthogonal direction V, and second guiding members 85 (a pair of second guiding members) facing to both face of the sheet S and guiding conveyance of the sheet S in a section corresponding to the reference sensors 81 and 82.

Further, each of the correcting units 44 and 45 includes pairs of switching rollers 65 (an example of a second conveying part) arranged at the upstream side from the pair of correcting rollers 66 in the conveying direction H to convey the sheet S to the pair of correcting rollers 66, a cam mechanism 93 (an example of a switching part) switching the pair of switching rollers 65 between a state sandwiching the sheet S and a state releasing sandwiching of the sheet S, a passage sensor 91 (an example of a passage detecting part) detecting passage of the sheet S, and third guiding members 95 facing to both face of the sheet S and guiding conveyance of the sheet S in a section corresponding to each pair of switching rollers 65.

Concretely, the pair of correcting rollers 66 is supported by a frame 77 (an example of a first frame) arranged below each of the correcting paths C1 and C2. The frame 77 is movable in the orthogonal direction V. The pair of correcting rollers 66 includes a driving part (not shown) composed of a motor, gears and others. The driving part drives a lower roller of the pair of correcting rollers 66 and makes an upper roller follow the lower roller and rotate. The sheet S is sandwiched at a contacting section of the upper roller and the lower roller and conveyed in a predetermined conveying direction H.

The first moving part 73 includes, for example, a rack 73R having a longitudinal direction of the orthogonal direction V, a pinion 73P meshed with the rack 73R, and a driving part (not shown) driving the pinion 73P. The rack 73R is fixed on a lower face of the frame 77, and the first moving part 73 moves the frame 77 in the orthogonal direction V.

The first guiding members 75 are arranged in the frame 77, and located at a left side and a right side of the pair of correcting rollers 66. The first guiding members 75 are plate-shaped members facing to both ends of the sheet S conveying on each of the correcting paths C1 and C2, and are supported by the frame 77.

Each of the reference sensors 81 and 82 is a reflection type photoelectric sensor having a light emitting part and a light receiving part, and when the light emitting part emits incident light upwardly and the sheet S reflects the incident light, the light receiving part receives reflected light. Each of the reference sensors 81 and 82 outputs a detection signal of an H (High) level when detecting the reflected light, but outputs a detection signal of an L (Low) level when not detecting the reflected light. Each of the reference sensors 81 and 82 is supported by a frame 87 (an example of a second frame) arranged below each of the correcting paths C1 and C2. The frame 87 is movable in the orthogonal direction V.

The second moving part 83 includes, for example, a rack 83R having a longitudinal direction of the orthogonal direction V, a pinion 83P meshed with the rack 83R, and a driving part (not shown) driving the pinion 83P. The rack 83R is fixed on a lower face of the frame 87, and the first moving part 83 moves the frame 87 in the orthogonal direction V.

The reference position corresponding to the end of the sheet S in the orthogonal direction V is a position of the end (a side end edge) of the sheet S in the orthogonal direction V in a case where displacement of the sheet S does not occur. The reference position is set for each size of the sheet S, and relationship of sheet size and the reference position is defined in control data stored in the storing part 12 described later. The second moving part 83 moves the reference sensors 81 and 82 to the reference position corresponding to size of the sheet S to be conveyed. Concretely, the second moving part 83 moves the reference sensors 81 and 82 so that the incident light passes through the reference position on each of the correcting paths C1 and C2.

The first reference sensor 81 and the second reference sensor 82 are juxtaposed in the orthogonal direction V and arranged in the frame 87. The first reference sensor 81 is used for the sheet S of a large size (e.g., JIS A4, A3, B5, B4), and the second reference sensor 82 is used for the sheet S of a small size (e.g., A5, B6, a postcard). Relationship of the sheet size and each of the first reference sensor 81 and the second reference sensor 82 is defined in the control data.

The second guiding members 85 are arranged in the frame 87, and are located above the reference sensors 81 and 82. The second guiding members 85 are plate-shaped members facing to both ends of the sheet S conveying on each of the correcting paths C1 and C2, and are supported by the frame 87. The second guiding member 85 has holes for passing the incident light from the reference sensors 81 and 82 to the sheet S at positions facing to the reference sensors 81 and 82. A distance D2 between the second guiding members 85 facing to both face of the sheet S is shorter than a distance D1 between the first guiding members 75 facing to both face of the sheet S.

Each pair of switching rollers 65 is supported by a frame 97 (an example of a third frame) arranged below each of the correcting paths C1 and C2. The frame 97 is supported by the housing 40. Each pair of switching rollers 65 includes a driving part (not shown) composed of a motor, gears and others. The driving part drives a lower roller of each pair of switching rollers 65 and makes an upper roller follow the lower roller and rotate. The sheet S is sandwiched at a contacting section of the upper roller and the lower roller and conveyed in a predetermined conveying direction H.

The cam mechanism 93 includes, for example, an eccentric cam being in contact with the upper roller of each pair of switching rollers 65, and a driving part (not shown) driving the eccentric cam to move the upper roller in the upward and downward directions between a nip position (refer to a solid line in FIG. 2A) sandwiching the sheet S with the lower roller and a nip releasing position (refer to a broken line in FIG. 2A) releasing sandwiching of the sheet S. That is, the cam mechanism 93 switches the pair of switching rollers 65 to a nip state sandwiching the sheet S or a nip releasing state releasing sandwiching of the sheet S.

The passage sensor 91 is located in a left end part (an end part at the downstream side in the conveying direction H) of the frame 97 within a range where the sheet S of minimum size passes. The passage sensor 91 is a photoelectric sensor having the same configuration as the reference sensors 81 and 82.

The third guiding members 95 are located at a left side and a right side of each pair of switching rollers 65. The third guiding members 95 are plate-shaped members similar to the first guiding members 75, and are supported by the frame 97. The third guiding member 95 has holes for passing the incident light from the passage sensor 91 to the sheet S at a position facing to the passage sensor 91.

As described above, each of the correcting units 44 and 45 is configured.

As shown in FIG. 1, the accelerating unit 46 is located on the third main path M3. The accelerating unit 46 includes two pairs of accelerating rollers 68, and a pair of ejecting rollers 69 located at the downstream side of the two pairs of accelerating rollers 68. The two pairs of accelerating rollers 68 are located at the upstream side from a joining point of the third main path M3 and a first bypass B1. The pair of ejecting rollers 69 are located at the downstream side from the joining point of the third main path M3 and the first bypass B1. Between the downstream side joining point DJ and the upstream side (lower side) pair of accelerating rollers 68, a pair of conveying rollers 70 are provided. At the downstream side from the pair of conveying rollers 70, a sheet sensor (not shown) detecting that a leading end of the sheet S passes through the pair of conveying rollers 70 is located.

The first bypass B1 is branched off from the inverting section 55 of the first inverting unit 41, and joins the downstream end of the third main path M3. The first bypass B1 is provided in an upper part of a space inside the housing 40. At a branching point of the inverting section 55 of the first inverting unit 41 and the first bypass B1, a second branching pawl 58 similar to the first branching pawl 54 is provided.

A second bypass B2 is branched off from the first inverting path I1. In a downstream end of the second bypass B2, an auxiliary tray 52 is arranged. The auxiliary tray 52 is provided in an upper face of the housing 40. At a branching point of the first inverting path I1 and the second bypass B2, a fifth branching pawl 62 similar to the first branching pawl 54 is provided.

An escape path S3 is branched off from the third main path M3 at the downstream side from the downstream side joining point DJ. In a downstream end of the escape path S3, an escape tray 53 is arranged. The escape tray 53 is provided in a center part of the housing 40. At a branching point of the third main path M3 and the escape path S3, a sixth branching pawl 63 similar to the first branching pawl 54 is provided.

Figure 3:
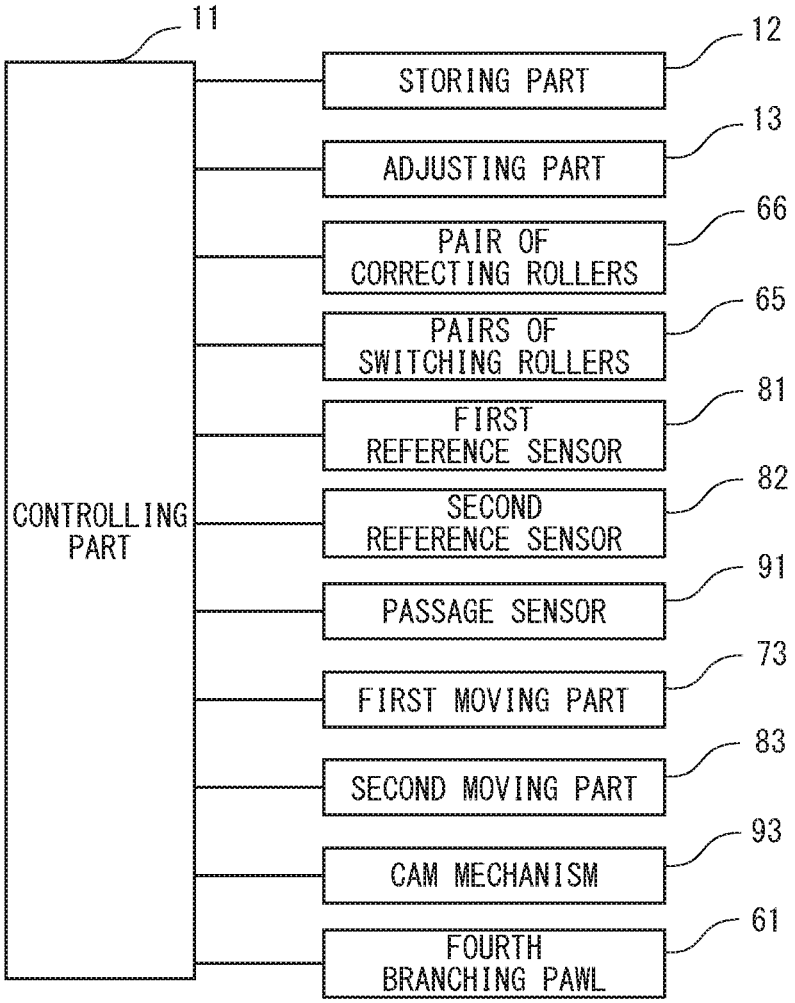
FIG. 3 is a block diagram showing the correcting unit according to the embodiment of the present disclosure.

Next, with reference to FIG. 3, structure for controlling the correcting units 44 and 45 of the relay conveyance device 4 will be described. FIG. 3 is a block diagram showing an electrical structure of the relay conveyance device 4. The relay conveyance device 4 includes a controlling part 11 (an example of a controller) and the storing part 12 and, to the controlling part 11, the pair of correcting rollers 66, the pairs of switching rollers 65, the first reference sensor 81, the second reference sensor 82, the passage sensor 91, the first moving part 73, the second moving part 83, the cam mechanism 93, and the fourth branching pawl 61 are connected. The controlling part 11 is an arithmetic unit, such as a CPU. The storing part 12 is a storing device, such as a ROM and a RAM. The controlling part 11 controls each component of the relay conveyance device 4 by using a control program and control data stored in the storing part 12. Incidentally, the controlling part 11 controls the inverting units 41 and 42 and others of the relay conveyance device 4, but explanation of their structure is omitted.

Next, with reference to FIGS. 1-2B, operation of the inverting units 41 and 42 of the relay conveyance device 4 will be described.

When the sheet S having the formed image is ejected from the ejecting port 24 of the image forming apparatus 2, the sheet S is introduced into the first main path M1 via the relay introducing port 50. In an example described below, an image forming job to a plurality of sheets S is inputted, and the plurality of sheets S having the images formed by the image forming apparatus 2 are introduced to the first main path M1 at predetermined intervals.

The first (odd-numbered) sheet S is introduced into the first inverting path I1 by the first branching pawl 54. The first inverting unit 41 inverts both faces of the sheet S introduced in the first inverting path I1 as described below.

First, each pair of inverting rollers 56 of the first inverting unit 41 are rotated in one direction, and the sheet S is introduced into the inverting section 55 of the first inverting unit 41. At that time, the second branching pawl 58 introduces the sheet S to a downstream part of the inverting section 55 of the first inverting unit 41. Subsequently, each pair of inverting rollers 56 of the first inverting unit 41 are rotated in an opposite direction to one direction to switch back the sheet S. The sheet S switched back as described above is introduced into the first joining path J1 by the third branching pawl 59, and guided to the upstream side joining point UJ. Thereby, both faces of the sheet S are inverted.

The second (even-numbered) sheet S is introduced into the second inverting path 12 by the first branching pawl 54. The second inverting unit 42 inverts both faces of the sheet S introduced in the second inverting path 12. Because operation inverting both faces of the sheet S by the second inverting unit 42 is similar to operation inverting both faces of the sheet S by the first inverting unit 41, its explanation is omitted.

The sheets S continuously introduced into the first main path M1 at predetermined intervals are introduced into the first inverting path I1 and the second inverting path 12 alternately by the first branching pawl 54. Thereby, the sheets S are fed to the first inverting unit 41 and the second inverting unit 42 alternately.

Thus, the sheet S inverted by the first inverting unit 41 or the second inverting unit 42 passes through the upstream side joining point UJ, and is introduced into the second main path M2. The fourth branching pawl 61 guides the sheet S passed through the second main path M2 to the first correcting path C1 and the second correcting path C2 alternately by the same operation as the first branching pawl 54.

Figure 4:
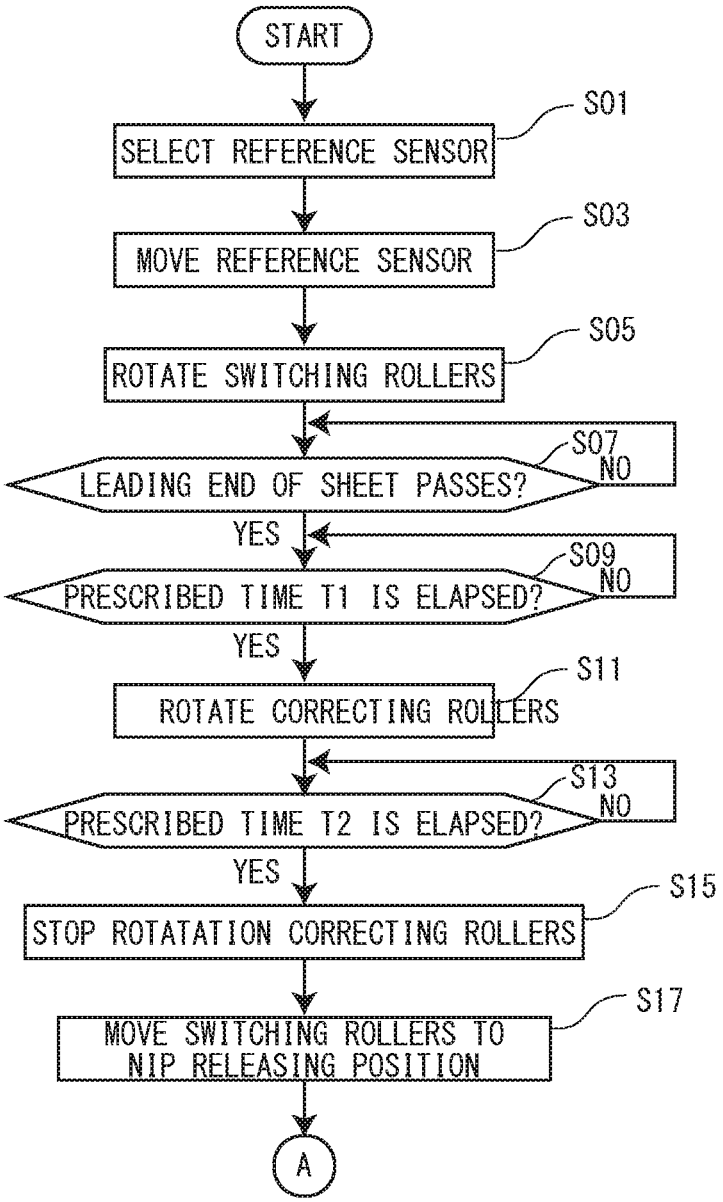
FIG. 4 is a flow chart showing control of the correcting unit according to the embodiment of the present disclosure.
Figure 5:
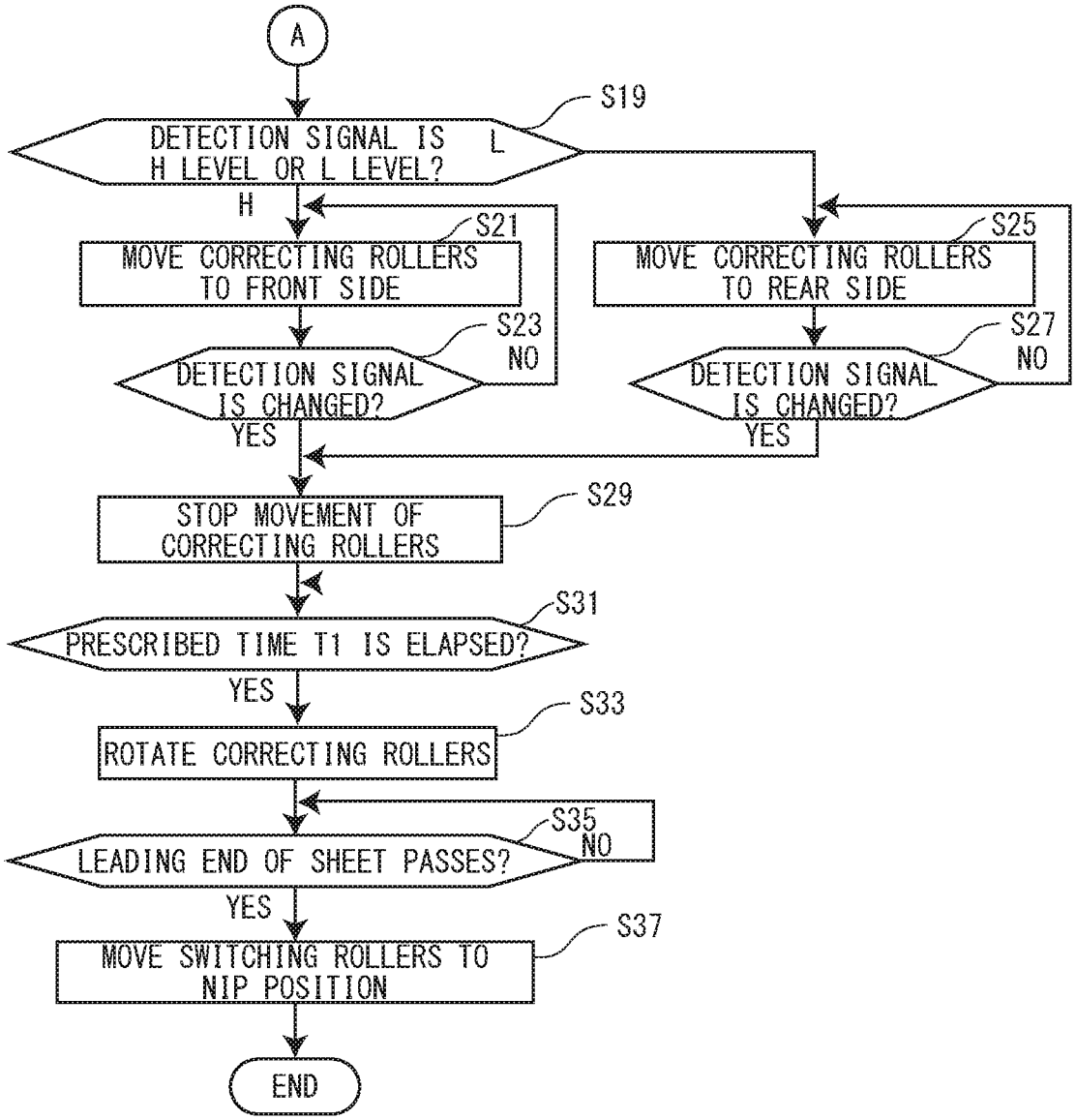
FIG. 5 is a flow chart showing control of the correcting unit according to the embodiment of the present disclosure.

Next, with reference to FIGS. 1-5, operation of the correcting units 44 and 45 will be described. FIGS. 4 and 5 are flow charts showing procedures of control of the correcting units 44 and 45. Incidentally, the correcting units 44 and 45 are initialized when the power of the image forming system 1 or the relay conveyance device 4 is turned on. Concretely, the pair of correcting rollers 66 are located at an initial position (a position shown in FIG. 2B) by the first moving part 73, the reference sensors 81 and 82 are located at initial positions (positions shown in FIG. 2B) by the second moving part 83, and the upper rollers of the pairs of switching rollers 65 are located at the nip positions (positions indicated by the solid line in FIG. 2A) by the cam mechanism 93. Rotations of the pair of correcting rollers 66 and the pairs of switching rollers 65 are stopped. When the image forming job is inputted in the image forming system 1, the correcting units 44 and 45 carry out operation described below.

The first (odd-numbered) sheet S is introduced into the first correcting path C1 by the fourth branching pawl 61. The first correcting unit 44 corrects displacement of the sheet S introduced in the first correcting path C1 as described below.

First (refer to FIG. 4), the controlling part 11 (an example of a selecting part) selects any one of the first reference sensor 81 and the second reference sensor 82 in accordance with sheet size designated by the image forming job (step S01). In a case where the sheet size is the large size (e.g., JIS A4, A3, B5, B4), the first reference sensor 81 is selected. Alternatively, in a case where the sheet size is the small size (e.g., A5, B6, a postcard), the second reference sensor 82 is selected. Here, as example, the sheet size designated by the image forming job is B5 size, and the first reference sensor 81 is selected.

Next, the controlling part 11 moves the selected first reference sensor 81 to the reference position according to the sheet size by the second moving part 83 (step 03).

Next, the controlling part 11 rotates the pair of switching rollers 65 (step S05). The sheet S is sandwiched by the pair of switching rollers 65 and conveyed in the predetermined conveying direction H.

Next, the controlling part 11 decides whether or not the leading end (downstream end) of the sheet S passes through a detection position of the passage sensor 91 (step S07). Concretely, when the leading end of the sheet S passes through the detection position, the detection signal outputted by the passage sensor 91 is changed from the L level to the H level. When the controlling part 11 inputs the detection signal changed from the L level to the H level, the controlling part 11 decides that the leading end of the sheet S passes through the detection position. The controlling part 11 repeats such decision at a constant interval until the leading end of the sheet S passes through the detection position, and shifts to step S09 after the leading end of the sheet S passes through the detection position (step S07: YES).

Next, the controlling part 11 decides whether or not a prescribed time T1 is elapsed (step S09). The prescribed time T1 is a time from passage of the leading end of the sheet S through the detection position until the leading end of the sheet S comes into contact with the contacting section of the pair of correcting rollers 66 (rotation is stopped) and a predetermined amount of deflection is made in the sheet S. The prescribed time T1 is includes in the control data. When the predetermined amount of deflection is made in the sheet S, skew of the sheet S with respect to the conveying direction H is corrected. The controlling part 11 repeats such decision at a constant interval until the prescribed time T1 is elapsed, and shifts to step S11 when the prescribed time T1 is elapsed (step S09: YES).

Next, the controlling part 11 rotates the pair of correcting rollers 66 (step S11). The sheet S is sandwiched by the pair of correcting rollers 66 and conveyed in the predetermined conveying direction H.

Next, the controlling part 11 decides whether or not a prescribed time T2 is elapsed (step S13). The prescribed time T2 is a time from start of rotation of the pair of correcting rollers 66 until expected timing when the leading end of the sheet S reaches the reference position of the reference sensor 81 or 82. The prescribed time T2 is common to all of the reference positions defined for different sizes of the sheet S. The prescribed time T2 is includes in the control data. In a case where displacement of the sheet S in an Fr direction (a front side) is caused, because the sheet S may not be detected by the reference sensor 81 or 82 even at the expected timing when the leading end of the sheet S reaches the reference position of the reference sensor 81 or 82, such decision is carried out.

Next, the controlling part 11 stops rotation of the pair of correcting rollers 66 (step S15). The pair of correcting rollers 66 stops conveyance of the sheet S at the expected timing when the leading end of the sheet S reaches the reference position.

Next, the controlling part 11 moves the upper roller of the pair of switching rollers 65 to the nip releasing position with the cam mechanism 93 (step S17). By such control, sandwiching of the sheet S by the pair of switching rollers 65 is released.

Next (refer to FIG. 5), the controlling part 11 decides whether level of the detection signal outputted by the first reference sensor 81 is the H level or the L level (step S19). In a case of the H level (step S19: H), process of the controlling part 11 is shifted to step S21. In a case of the L level (step S19: L), process of the controlling part 11 is shifted to step S25.

At step S21, the controlling part 11 moves the pair of correcting rollers 66 to the front side (the Fr direction) by a predetermined amount with the first moving part 73.

Next, the controlling part 11 decides whether or not level of the detection signal is changed from the H level to the L level (step S23). The controlling part 11 repeats process of steps S21 to S23 at a constant interval until level of the detection signal is changed from the H level to the L level and shifts to step S29 in a case where level of the detection signal is changed from the H level to the L level (step S23: YES).

On the other hand, at step S25, the controlling part 11 moves the pair of correcting rollers 66 to a rear side (an Rr direction) by a predetermined amount with the first moving part 73.

Next, the controlling part 11 decides whether or not level of the detection signal is changed from the L level to the H level (step S27). The controlling part 11 repeats process of steps S25 to S27 at a constant interval until level of the detection signal is changed from the L level to the H level and shifts to step S29 in a case where level of the detection signal is changed from the L level to the H level (step S27: YES).

At step S29, the controlling part 11 stops movement of the pair of correcting rollers 66. A flow of steps S19 to S29 is one example of processes in which the first moving part 73 moves the pair of correcting rollers 66 in a predetermined direction out of two directions in the orthogonal direction V in accordance with a detection result of the reference sensor 81 or 82 after conveyance of the sheets S is stopped and stops movement of the pair of correcting rollers 66 after the detection result of the reference sensor 81 or 82 is changed. By steps S19, S21, S23 and S29, displacement of the sheet S in the orthogonal direction V (the Rr direction) is corrected. By steps S19, S25, S27 and S29, displacement of the sheet S in the orthogonal direction V (the Fr direction) is corrected.

Next, the controlling part 11 decides after the leading end of the sheet S is passed through the detection position of the passage sensor 91 (refer to step S07 in FIG. 4) whether or not a prescribed time T3 is elapsed (step S09). The prescribed time T3 is a time from passage of the leading end of the sheet S through the detection position of the passage sensor 91 until displacement of an expected maximum displacement amount is corrected. The prescribed time T3 is includes in the control data. The controlling part 11 repeats such decision at a constant interval until the prescribed time T3 is elapsed, and shifts to step S33 when the prescribed time T3 is elapsed (step S31: YES).

Next, the controlling part 11 rotates the pair of correcting rollers 66 (step S33). The sheet S is sandwiched by the pair of correcting rollers 66 and conveyed in the predetermined conveying direction H.

At steps S31 and S33, regardless of the displacement amount of displacement of the sheet S, the sheet S after displacement correction is fed out at a constant interval. That is, such process is one example of process in which the pair of correcting rollers 66 restarts conveyance of the sheet S at timing when an interval between the sheets S in the third main path M3 becomes equal to an interval between the sheets S in the second main path M2.

Next, the controlling part 11 decides whether or not a trailing end (upstream end) of the sheet S passes through the detection position of the passage sensor 91 (step S35). Concretely, when trailing end of the sheet S passes through the detection position of the passage sensor 91, a detection signal outputted from the passage sensor 91 changes from the H level to the L level. The controlling part 11 decides that the trailing end of the sheet S passes through the detection position when the detection signal changes from the H level to the L level. The controlling part 11 repeats such process at a constant interval until deciding passage of the trailing end of the sheet S through the detection position, and shifts to step S37 when deciding passage of the trailing end of the sheet S through the detection position (step S35: YES).

Next, the controlling part 11 moves the upper roller of the pair of switching rollers 65 to the nip position with the cam mechanism 93 (step S37).

The second (even-numbered) sheet S is introduced into the second correcting path C2 by the fourth branching pawl 61. The second correcting unit 45 corrects displacement of the sheet S introduced in the second correcting path C2. Since operation correcting displacement of the sheet S by the second correcting unit 45 is similar to operation correcting displacement of the sheet S by the second correcting unit 45, its explanation is omitted.

The sheet S thus corrected by the first correcting unit 44 and the second correcting unit 45 passes through the downstream side joining point DJ and is introduced into the third main path M3.

Incidentally, an interval between the sheets S continuously introduced from the image forming apparatus 2 to the relay conveyance device 4 is equal to a distance D (refer to FIG. 1) between the first correcting path C1 and the second correcting path C2 in the upward and downward directions. Moreover, a distance from the downstream side branching point DB to the pair of correcting rollers 66 of the first correcting unit 44 is longer than a distance from the downstream side branching point DB to the pair of correcting rollers 66 of the second correcting unit 45 by the distance D. Therefore, time when the leading end of the first (odd-numbered) sheet S reaches the pair of correcting rollers 66 of the first correcting unit 44 becomes equal to time when the leading end of the second (even-numbered) sheet S reaches the pair of correcting rollers 66 of the second correcting unit 45. Thereby, correction of the position of the first sheet S in the orthogonal direction V by the first correcting unit 44 and correction of the position of the first sheet S in the orthogonal direction V by the second correcting unit 45 are simultaneously carried out.

After the position of the sheet S in the orthogonal direction V is corrected by the first correcting unit 44 or the second correcting unit 45 as described above, the sheet S is introduced into the accelerating unit 46. When passage of the trailing end of the sheet S through the pair of conveying rollers 70 is detected by a sheet sensor, rotation speed of the pairs of rollers 68 and 69 of the accelerating unit 46 is increased, the pairs of rollers 68 and 69 accelerates the sheet S. The sheet S accelerated by the pairs of rollers 68 and 69 is ejected from the relay conveyance device 4 via the relay ejecting port 51 and introduced into the conveyance path Y of the post-processing device 3 via the introducing port 38.

Incidentally, there are cases not requiring inversion and correction of the position in the orthogonal direction V. As an example, there is a case where the number of the sheets designated by the image forming job is one. In this case, the sheet S is introduced into the first inverting path I1, passes through the first bypass B1, is introduced into the downstream end of the third main path M3, and is introduced into the conveyance path Y via the relay ejecting port 51 and the introducing port 38.

Moreover, there is a sheet S not requiring inversion and correction of the position in the orthogonal direction V and not requiring post-process of the post-processing device 3 (hereinafter, called as a "sheet S not requiring processes"). The sheet S not requiring processes is, for example, an envelope. The sheet S not requiring processes is introduced into the first inverting path I1, passes through the second bypass B2, and is ejected to the auxiliary tray 52.

Further, the relay conveyance device 4 is configured so as to escape the sheet S to the escape tray 53 in a case where jam of the sheet S is caused in the post-processing device 3.

Next, actions and effects of the image forming system 1 will be described.

In the present embodiment, the pair of correcting rollers 66 stops conveyance of the sheet S at the expected timing when the leading end of the sheet S reaches the reference position, and the first moving part 73 moves the pair of correcting rollers 66 in the predetermined direction out of two directions in the orthogonal direction V in accordance with the detection result of the reference sensor 81 or 82 after conveyance of the sheets S is stopped, and stops movement of the pair of correcting rollers 66 after the detection result of the reference sensor 81 or 82 is changed. In accordance with such a configuration, without detecting the displacement amount of the position of the sheet S in the orthogonal direction to the conveying direction, it is possible to correct the displacement of the sheet S. As a result, it is possible to improve accuracy of post-process in the post-processing 3. In addition, since detection of the displacement amount is not required, correction of the displacement can be processed at high speed and it is possible to improve productivity.

Moreover, in the embodiment, the second moving part 83 moves the reference sensors 81 and 82 to the reference positions corresponding to the size of the sheet S to be conveyed. In accordance with such a configuration, even if the sheets S of different sizes having different positions of the ends in the orthogonal direction V are used, it is possible to correct displacement of the sheet S.

Further, in the embodiment, after the predetermined amount of deflection is made in the sheet S by the pair of correcting rollers 66, conveyance of the sheet S is started. In accordance with such a configuration, it is possible to correct skew of the sheet S.

Furthermore, in the embodiment, after the cam mechanism 93 switches the pair of switching rollers 65 to a state releasing sandwiching the sheet S, the first moving part 73 moves the pair of correcting rollers 66. In accordance with such a configuration, it is possible to prevent that the pair of switching rollers 65 disturbs correction of displacement of the sheet S in the pair of correcting rollers 66.

Moreover, in the embodiment, the distance D2 between the second guiding members 85 facing to both face of the sheet S is shorter than the distance D1 between the first guiding members 75 facing to both face of the sheet S. In accordance with such a configuration, even if curl (winding habit) is caused in the sheet S, it is possible to restrain degradation of detection accuracy of the sheet S in the reference sensors 81 and 82.

Further, in the embodiment, the correcting units 44 and 45 are arranged for the first correcting path C1 and the second correcting path C2 having equal conveyance distances, and the fourth branching pawl 61 guides the sheet S to the first correcting path C1 and the second correcting path C2 alternately. In accordance with such a configuration, it is possible to shorten waiting time for correction of displacement and to improve productivity.

Furthermore, in the embodiment, after the leading end of the sheet S passes through the detection position of the passage sensor 91, when the prescribed time T3 is elapsed, the pair of correcting rollers 66 is rotated. In accordance with such a configuration, even if respective displacement amounts of positions of the sheets S are different, since conveyance of the sheet S is restarted at timing when the interval between the sheets S in the third main path M3 becomes equal to the interval between the sheets S in the second main path M2, it is unnecessary to adjust timing of the post-process in the post-processing device 3 and to adjust an interval between the sheets S in the post-processing device 3.

Moreover, in the embodiment, the reference sensors 81 and 82 are arranged in the orthogonal direction V, and any one of the reference sensors 81 and 82 is selected in accordance with the size of the sheet S to be conveyed. In accordance with such a configuration, it is possible to shorten time moving the reference sensors 81 and 82.

Next, an example modified the embodiment will be described. If machining accuracy or assembling accuracy of components of the correcting units 44 and 45, or detection accuracy of the reference sensors 81 and 82, or others is uneven, it may be necessary to set difference reference positions in the first correcting path C1 and the second correcting path C2. Thereupon, the relay conveyance device 4 may include an adjusting part 13 adjusting the control data and adjusting the reference positions of the reference sensors 81 and 82. For example, a sensor detecting the end of the sheet S in the orthogonal direction V may be arranged on the second main path M2 or the third main path M3, and, in a case where displacement of the end reaches a predetermined threshold value, the controlling part 11 may rewrite the reference position included in the control data in accordance with a displacement amount.

In the embodiment, the post-processing device 3 (so-called as a finisher) including the post-processing mechanisms is used as the post-processing device of the present disclosure. On the other hand, a sheet stacking device (so-called as a stacker) not including the post-processing mechanisms may be used as the post-processing device of the present disclosure.

While the present disclosure has been described with reference to the particular illustrative embodiments, it is not to be restricted by the embodiments. It is to be appreciated that those skilled in the art can change or modify the embodiments without departing from the scope and spirit of the present disclosure.

The invention claimed is:

1. A sheet conveying device comprising:

a correcting unit arranged between an upstream side conveying path and a downstream side conveying path, correcting displacement of a sheet conveyed from the upstream side conveying path, and conveying the sheet to the downstream side conveying path; and a controller controlling the correcting unit;

wherein the correcting unit includes:

a first conveying part conveying the sheet;

a first frame supporting the first conveying part;

a first moving part moving the first frame in a width direction orthogonal to a conveying direction;

a detecting part arranged at a downstream side from the first conveying part in the conveying direction, and detecting a side end edge of the sheet in the width direction at a predetermined reference position; and a second frame supporting the detecting part, the reference position is a position through where the side end edge of the sheet passes without displacement in the width direction, the controller drives the first conveying part to convey the sheet and to stop conveyance of the sheet at timing when a leading end of the sheet reaches the detecting part, in a state that the driving of the first conveying part is stopped, drives the first moving part to move the first frame in the width direction and thereby to move the sheet in the width direction, and to stop movement of the first frame at a position of the first frame when detection result of the detecting part is changed and thereby to position the side end edge of the sheet to the reference position to correct displacement of the sheet, and drives the first conveying part to convey the sheet to the downstream side conveying path, wherein the sheet conveying device further comprises:

a pair of first guiding members arranged facing to each other in the first frame and guiding conveyance of the sheet in the first conveying part; and a pair of second guiding members arranged facing to each other in the second frame and guiding conveyance of the sheet in a section corresponding to the detecting part; and wherein a distance between the pair of second guiding members is shorter than a distance between the pair of first guiding members.

2. The sheet conveying device according to claim 1 further comprising:

a storing part storing control data defining the reference position; and an adjusting part adjusting the reference position based on the control data.

3. A relay conveyance device arranged between an image forming apparatus and a post-processing device carrying out post-process to a sheet having an image formed by the image forming apparatus, and including a relay conveyance path conveying the sheet from the image forming apparatus to the post-processing device, wherein the relay conveyance device is the sheet conveying device according to claim 1.

4. An image forming system comprising:

an image forming apparatus forming an image to a sheet;

a post-processing device carrying out post-process to the sheet having an image formed by the image forming apparatus; and a relay conveyance device according to claim 3 to convey the sheet from the image forming apparatus to the post-processing device.

5. The sheet conveying device according to claim 1 further comprising:

a second moving part moving the second frame in the width direction, wherein the reference position includes a plurality of reference positions corresponding to various sizes of sheets to be conveyed, the controller controls the second moving part to move the detecting part to any one of the plurality of reference positions corresponding to the size of the sheet to be conveyed.

6. The sheet conveying device according to claim 1, wherein the correcting unit further includes:

a second conveying part arranged at an upstream side from the first conveying part in the conveying direction and a third frame supporting the second conveying part, the controller controls so that a leading end of the sheet conveyed from the second conveying part comes into contact with the first conveying part in a stopped state to make deflection in the sheet and thereby to correct skew of the sheet.

7. The sheet conveying device according to claim 6, wherein the second conveying part includes a pair of switching rollers, the correcting unit further includes a switching part switching the pair of switching rollers to a nip state nipping the sheet or a nip releasing state releasing nipping of the sheet, the controller drives the first moving part to move the first frame in the width direction, after the pair of switching rollers is switched into the nip releasing state.

8. A sheet conveying device comprising:

a correcting unit arranged between an upstream side conveying path and a downstream side conveying path, correcting displacement of a sheet conveyed from the upstream side conveying path, and conveying the sheet to the downstream side conveying path; and a controller controlling the correcting unit;

wherein the correcting unit includes:

a first conveying part conveying the sheet;

a first frame supporting the first conveying part;

a first moving part moving the first frame in a width direction orthogonal to a conveying direction;

a detecting part arranged at a downstream side from the first conveying part in the conveying direction, and detecting a side end edge of the sheet in the width direction at a predetermined reference position; and a second frame supporting the detecting part, the reference position is a position through where the side end edge of the sheet passes without displacement in the width direction, the controller drives the first conveying part to convey the sheet and to stop conveyance of the sheet at timing when a leading end of the sheet reaches the detecting part, in a state that the driving of the first conveying part is stopped, drives the first moving part to move the first frame in the width direction and thereby to move the sheet in the width direction, and to stop movement of the first frame at a position of the first frame when detection result of the detecting part is changed and thereby to position the side end edge of the sheet to the reference position to correct displacement of the sheet, and drives the first conveying part to convey the sheet to the downstream side conveying path, wherein the detecting part includes a plurality of detecting parts arranged along the width direction on the second frame, the controller selects any one of the plurality of detecting parts in accordance with the size of the sheet to be conveyed.

9. The sheet conveying device according to claim 8 further comprising:

a second moving part moving the second frame in the width direction, wherein the reference position includes a plurality of reference positions corresponding to various sizes of sheets to be conveyed, the controller controls the second moving part to move the detecting part to any one of the plurality of reference positions corresponding to the size of the sheet to be conveyed.

10. The sheet conveying device according to claim 8, wherein the correcting unit further includes:

a second conveying part arranged at an upstream side from the first conveying part in the conveying direction and a third frame supporting the second conveying part, the controller controls so that a leading end of the sheet conveyed from the second conveying part comes into contact with the first conveying part in a stopped state to make deflection in the sheet and thereby to correct skew of the sheet.

11. The sheet conveying device according to claim 10, wherein the second conveying part includes a pair of switching rollers, the correcting unit further includes a switching part switching the pair of switching rollers to a nip state nipping the sheet or a nip releasing state releasing nipping of the sheet, the controller drives the first moving part to move the first frame in the width direction, after the pair of switching rollers is switched into the nip releasing state.

12. The sheet conveying device according to claim 8 further comprising:

a storing part storing control data defining the reference position; and an adjusting part adjusting the reference position based on the control data.

13. A relay conveyance device arranged between an image forming apparatus and a post-processing device carrying out post-process to a sheet having an image formed by the image forming apparatus, and including a relay conveyance path conveying the sheet from the image forming apparatus to the post-processing device, wherein the relay conveyance device is the sheet conveying device according to claim 8.

14. An image forming system comprising:

an image forming apparatus forming an image to a sheet;

a post-processing device carrying out post-process to the sheet having an image formed by the image forming apparatus; and a relay conveyance device according to claim 13 to convey the sheet from the image forming apparatus to the post-processing device.

15. A sheet conveying device comprising:

a correcting unit arranged between an upstream side conveying path and a downstream side conveying path, correcting displacement of a sheet conveyed from the upstream side conveying path, and conveying the sheet to the downstream side conveying path; and a controller controlling the correcting unit;

wherein the correcting unit includes:

a first conveying part conveying the sheet;

a first frame supporting the first conveying part;

a first moving part moving the first frame in a width direction orthogonal to a conveying direction;

a detecting part arranged at a downstream side from the first conveying part in the conveying direction, and detecting a side end edge of the sheet in the width direction at a predetermined reference position; and a second frame supporting the detecting part, the reference position is a position through where the side end edge of the sheet passes without displacement in the width direction, the controller drives the first conveying part to convey the sheet and to stop conveyance of the sheet at timing when a leading end of the sheet reaches the detecting part, in a state that the driving of the first conveying part is stopped, drives the first moving part to move the first frame in the width direction and thereby to move the sheet in the width direction, and to stop movement of the first frame at a position of the first frame when detection result of the detecting part is changed and thereby to position the side end edge of the sheet to the reference position to correct displacement of the sheet, and drives the first conveying part to convey the sheet to the downstream side conveying path, wherein the sheet conveyance device further comprising:

a first correcting path and a second correcting path branched off from an end at a downstream side in the conveying direction on the upstream side conveying path, arranged parallel to each other, and joining at their ends at the downstream side in the conveying direction; and a guiding part guiding the sheet conveyed from the upstream side conveying path to the first correcting path and the second correcting path alternately, wherein a conveyance distance of the first correcting path is equal to a conveyance distance of the second correcting path, on each of the first correcting path and the second correcting path, the first conveying part, the detecting part and the first moving part are arranged.

16. The sheet conveying device according to claim 15 further comprising:

a second moving part moving the second frame in the width direction, wherein the reference position includes a plurality of reference positions corresponding to various sizes of sheets to be conveyed, the controller controls the second moving part to move the detecting part to any one of the plurality of reference positions corresponding to the size of the sheet to be conveyed.

* * * * *